US008814455B2

(12) United States Patent
Golden

(10) Patent No.: US 8,814,455 B2
(45) Date of Patent: Aug. 26, 2014

(54) TWO-DIMENSIONAL COSMETIC SYSTEM AND METHOD WITH APPLICATOR

(76) Inventor: Debra Golden, San Rafael, CA (US)

( * ) Notice: Subject to any disclaimer, the term of this patent is extended or adjusted under 35 U.S.C. 154(b) by 608 days.

(21) Appl. No.: 13/042,423

(22) Filed: Mar. 7, 2011

(65) Prior Publication Data

US 2012/0230750 A1 Sep. 13, 2012

(51) Int. Cl.

| | |
|---|---|
| ***A46B 5/02*** | (2006.01) |
| ***A45D 40/26*** | (2006.01) |
| ***A45D 40/00*** | (2006.01) |

(52) U.S. Cl.

CPC ..... *A45D 40/26* (2013.01); *A45D 2200/1018* (2013.01); *A45D 2200/1036* (2013.01); *A45D 40/0087* (2013.01)

USPC ..... 401/8; 401/6; 401/132

(58) Field of Classification Search

USPC ..... 401/6–8, 161–162, 132

See application file for complete search history.

(56) References Cited

U.S. PATENT DOCUMENTS

| | | | | |
|---|---|---|---|---|
| 5,678,273 | A * | 10/1997 | Porcelli | 15/104.94 |
| 5,980,960 | A * | 11/1999 | Amitai | 426/115 |
| 7,416,358 | B2 * | 8/2008 | Legendre | 401/205 |
| 7,470,077 | B2 * | 12/2008 | Thiebaut et al. | 401/132 |
| 8,393,043 | B2 * | 3/2013 | Limongi et al. | 15/209.1 |
| 2004/0071494 | A1 * | 4/2004 | Staniforth et al. | 401/262 |
| 2006/0045607 | A1 * | 3/2006 | Thiebaut et al. | 401/132 |

* cited by examiner

*Primary Examiner* — David Walczak
*Assistant Examiner* — Jennifer C Chiang
(74) *Attorney, Agent, or Firm* — Nwamu, P.C.; Fidel D. Nwamu

(57) ABSTRACT

A cosmetic device for applying makeup onto the lip area. The cosmetic device includes a top layer. The top layer includes a cosmetic applicator. The cosmetic device also includes a bottom layer aligned with and attached to the top layer. The top and bottom layers are attached in a two-dimensional manner so as to seal the cosmetic applicator and a product area between the top and the bottom layer.

19 Claims, 3 Drawing Sheets

TWO-DIMENSIONAL COSMETIC SYSTEM AND METHOD WITH APPLICATOR

BACKGROUND OF THE INVENTION

The present invention relates generally to cosmetic systems and methods and more specifically to cosmetic systems and methods that are two-dimensional and adapted for substantial single use.

Cosmetic products such as lipsticks, nail polish, eye polish, facial makeup and the like are generally utilized to enhance the appearance of a user's body or skin. In particular, lipsticks for applying a colored substance to the lip area remain popular.

Lipsticks are usually encased in casings or tubes. Such casings or tubes are often three-dimensional. This three-dimensional packaging often requires the user to carry a handbag, a pocketbook or the like for storing the lipstick during an outing or when away from home. As an example, a user wearing form-fitting pants or jeans desiring to carry such three-dimensional lipstick casings or tubes in a jeans pocket cannot do so but must utilize a handbag or pocketbook for storage.

The handbag of course might include numerous other items e.g., a purse, mobile phone, and the lipstick. It is not uncommon for such handbags to become unwieldy and heavy for the user to carry. So the trend for many users is to travel light and carry only items that are considered necessary.

One item that many users carry is lipstick. Another such item is a cellular or mobile communication device since for communicating and in some cases for use as a mobile wallet (thus eliminating the need for a purse).

Mobile communication devices are typically carried in a pouch or casing attached to the user's person. And so, ideally, a user might wish to carry a mobile communication device in the pouch and carry no other items except those that can fit into the pouch along with the mobile communication device.

Although a user can attempt to carry flat cosmetic samplers, such cosmetic samplers are intended for product testing and are not particularly adapted for use during an outing. Users must also use their fingers as an applicator for scooping and applying the product sample for use.

It is within the aforementioned context that a need for the present invention has arisen and the present invention meets this need by addressing one or more of the foregoing disadvantages of conventional systems and methods.

BRIEF SUMMARY OF THE INVENTION

Various aspects of a two-dimensional cosmetic device and method with applicator can be found in exemplary embodiments of the present invention.

In a first embodiment, a cosmetic device for applying makeup onto the lip area is disclosed. The cosmetic device is two-dimensional and includes a top layer attached to a bottom layer. This top layer includes a cosmetic applicator on its interior surface. Perforations are placed on the top layer around the periphery of the cosmetic applicator. In this manner, a user can tear around the perforations and then lift the cosmetic applicator to apply cosmetic product onto the lip area. Unlike conventional cosmetic devices, users need not use their fingers for scooping and applying cosmetic products.

The bottom layer of the present invention also includes a product area on the interior surface. This bottom layer is aligned with and attached to the top layer so that the cosmetic applicator and product area are sealed between the bottom and the top layer while remaining two-dimensional. In this manner, a user can fit the two-dimensional cosmetic device that remains flat into a mobile phone pouch along with a mobile phone. The user need not carry a handbag for storing the cosmetic device unlike conventional cosmetic devices. Note also that the cosmetic device of the present invention is substantially for single use.

A further understanding of the nature and advantages of the present invention herein may be realized by reference to the remaining portions of the specification and the attached drawings. Further features and advantages of the present invention, as well as the structure and operation of various embodiments of the present invention, are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail as to not unnecessarily obscure aspects of the present invention.

Figure 1:
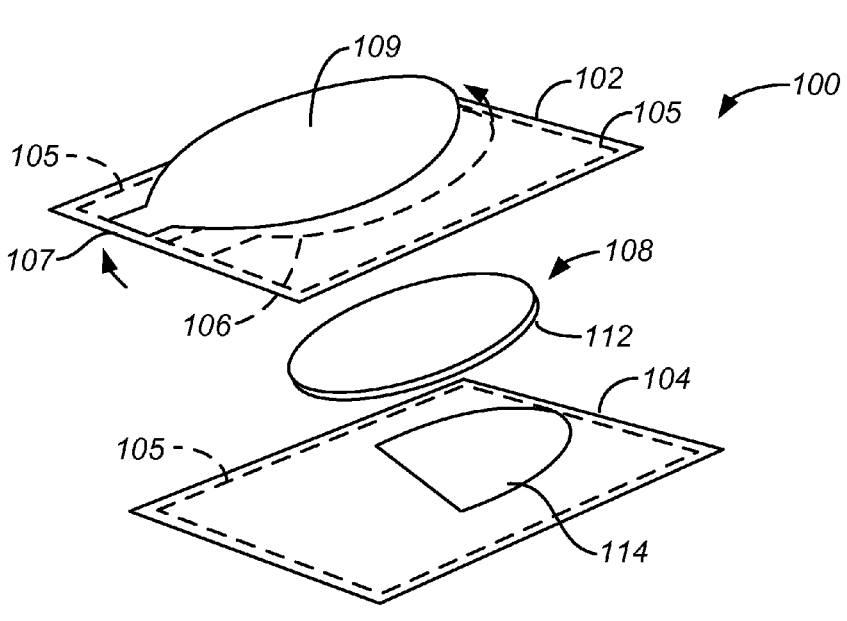
FIG. 1 illustrates a cosmetic system according to an exemplary embodiment of the present invention.

FIG. 1 illustrates cosmetic system 100 according to an exemplary embodiment of the present invention.

Figure 4:
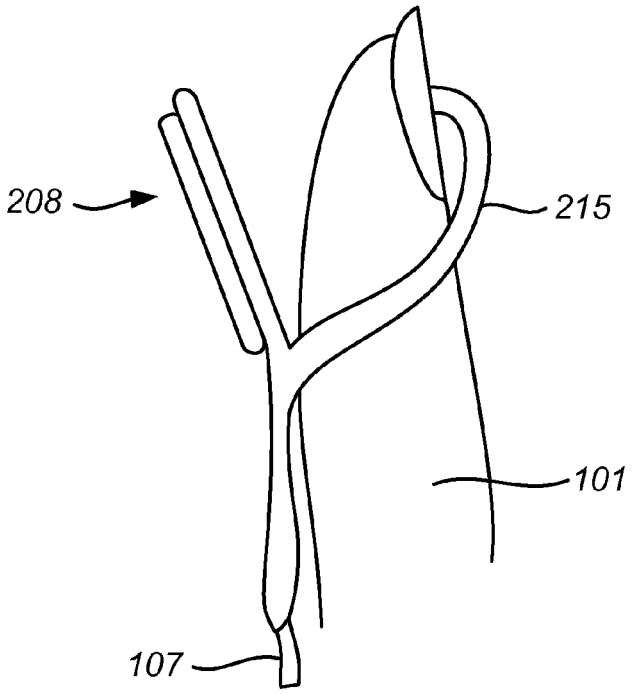
FIG. 4 illustrates a user's finger inserted into the cosmetic system of FIG. 2 according to an exemplary embodiment of the present invention.

In FIG. 1, user 101 of FIG. 4 can utilize cosmetic system 100 for applying makeup such as lipstick, lip gloss and the like onto the lip area. Among other components, cosmetic system 100 includes top layer 102 attached to bottom layer 104 as shown. Top layer 102 and bottom layer 104 are attached around their periphery generally indicated by hashed lines 105. Top layer 102 and bottom layer 104 can be attached by heat sealing, bonding or any other known methods consistent with the spirit and scope of the present invention.

Top layer 102 is preferably substantially planar and preferably substantially rectangular in shape. Here, top layer 102 serves a two-fold functionality. First, top layer 102 serves as an exterior cover for cosmetic system 100. This exterior cover preserves the contents of cosmetic system 100.

Second, unlike conventional cosmetic systems, top layer 102 also provides an interior surface to which applicator 108 is attached. In FIG. 1, top layer 102 also includes perforations 106 running generally within the perimeter of the rectangular-shaped top layer 102.

Perforations 106 define applicator top layer 109, which defines the outer periphery of applicator 108 discussed below. Applicator top layer 109 is shown detached from and above top layer 102. Applicator top layer 109 also includes tab 107 by which user 101 can pull and detach applicator top layer 109 from top layer 102.

Top layer 102 can be made of flexible packaging or biodegradable material such as thin aluminum foil, VMPET (VMetalized Polyethylene Terephthalate), etc. Such material should also allow for vacuum sealing or other processes that can prevent dry-out of the cosmetic product deposited within cosmetic system 100. Other materials consistent with the spirit and scope of the present invention can also be employed.

The dimensions of top layer 102 are user-dependent; preferably, such a dimension should allow for a sufficient length and width for applicator 108. Applicator 108 should cover a reasonable amount of lip area without multiple coatings.

In FIG. 1, as noted, cosmetic system 100 also includes applicator 108 for applying products such as lipstick or the like onto the lip area. Applicator 108 might include a stiff backing such as cardboard. Alternatively, the cardboard could be integrated with applicator top layer 109. Applicator 108 also includes pad 112 for coating the lip area with cosmetic product. Pad 112 can be made of dense foam-like material on which cosmetic product can remain.

Applicator 108 is fixedly attached to the interior portion of applicator top layer 109. In this manner, by pulling tab 107 and tearing around perforations 106, user 101 can lift applicator 108 in readiness for use. Preferably, the dimensions of applicator 108 are well within the boundaries of applicator top layer 109. Applicator 108 is also attached to the interior of applicator top layer 109 such that pad 112 is aligned with the product area 114.

In FIG. 1, bottom layer 104 of the cosmetic system 100 is also substantially planar and rectangular-shaped such that it is aligned and congruent with top layer 102. When bottom layer 104 and top layer 102 are attached, cosmetic system 100 remains essentially planar and two-dimensional.

When bottom layer 104 and top layer 102 are attached, applicator 108 on the interior side of top layer 102 is sealed within cosmetic system 100 while maintaining two-dimensionality. The user can access applicator 108 for use by employing tab 107 to pull along and tear along perforations 106 to detach applicator top area 109. Once applicator top area 109 is detached, applicator 108 attached to the underside of applicator top area 109 becomes accessible. User 101 can then utilize pad 112 for dabbing product area 114 for application onto the lip area.

Cosmetic system 100 is preferably at least 1 by 1 inch (2.54 by 2.54 centimeters) and no more than 4.5 by 2.5 inches (11.43 by 6.35 centimeters); but, such dimensions depend upon the mobile phone pouch that cosmetic system 100 is used for. In this manner, cosmetic system 100 remains essentially planar and substantially two-dimensional such that a user can fit a packet of cosmetic system 100 into a mobile phone pouch along with the intended mobile phone or can be fit into a tight jeans back-pocket.

Bottom layer 104 serves a two-fold function as well. First, bottom layer 104 serves as the second exterior cover for cosmetic system 100. This exterior cover also protects the contents of cosmetic system 100. Second, bottom layer 104 also provides an inside surface onto which product area 114 is placed. Product area 114 can contain wax-based or other type cosmetic products such as lipsticks, lip gloss or other products for use by user 101; such cosmetic products being consistent with the spirit and scope of the present invention.

Cosmetic product can be deposited onto product area 114 by any known methods including screen printing, spraying or any other methods consistent with the spirit and scope of the present invention. The amount of cosmetic product is sufficient for no more than a substantial single use (and additional coats). The amount of cosmetic product is just right because excess cosmetic product beyond that for substantial single use might result in loss of the two-dimensional benefit of the present invention.

As shown, product area 114 might include a well for containing the cosmetic product as generally known in the art. In such a case, the well might be covered with a thin sheet of polyester film or polypropylene laminate, which can be removed by the user immediately prior to use.

In operation, user 101 wishing to utilize cosmetic system 100 for applying makeup such as lipstick to the lip area begins by grasping tab 107 and exerting a pulling force away from top layer 102. By so doing, user 101 begins to tear around perforations 106. Once tearing is completed, applicator top layer 109 with applicator 108 is completely detached from top layer 102. At this point, user 101 can hold applicator top layer 109 and applicator 108 such that applicator 108 is facing the lip area.

In one embodiment, pad 112 and product area 114 are in contact when top layer 102 and bottom layer 104 are attached. Once applicator 108 (and applicator top layer 109 are detached from top layer 102, pad 112 thus contains cosmetic product either applied or absorbed into pad 112 via contact. User 101 can employ pad 112 with the cosmetic product onto the lip area. User 101 can apply additional coats no more than substantial single use.

After use, cosmetic system 100 is discarded. That is, cosmetic system 100 is for substantial single use. By substantial single use, it is meant that cosmetic system 100 should be used no more than once, twice or three times or thereabout depending upon how heavily the cosmetic product is used the first time.

Note that an advantage of the present invention is that there is sufficient cosmetic product for substantial single use including multiple coats unlike conventional devices such as cosmetic product samplers that might contain only sufficient quantity for testing but not for substantial single use. Not only does the present invention contain sufficient product for substantial single use, it contains the right amount. If too much cosmetic product is included beyond that needed for substantial single use, the two-dimensional nature of the product might be lost as the cosmetic system becomes bulky and three-dimensional.

In an alternate embodiment, user 101 might need to remove a polyester film that overlays product area 114 before use. In that case, upon lifting applicator 108, user 101 removes the polyester film overlay before using pad 112 to dab product area 114. User 101 can then begin using applicator 108 to apply the cosmetic product onto the lip area as further illustrated in FIG. 4.

Figure 2:
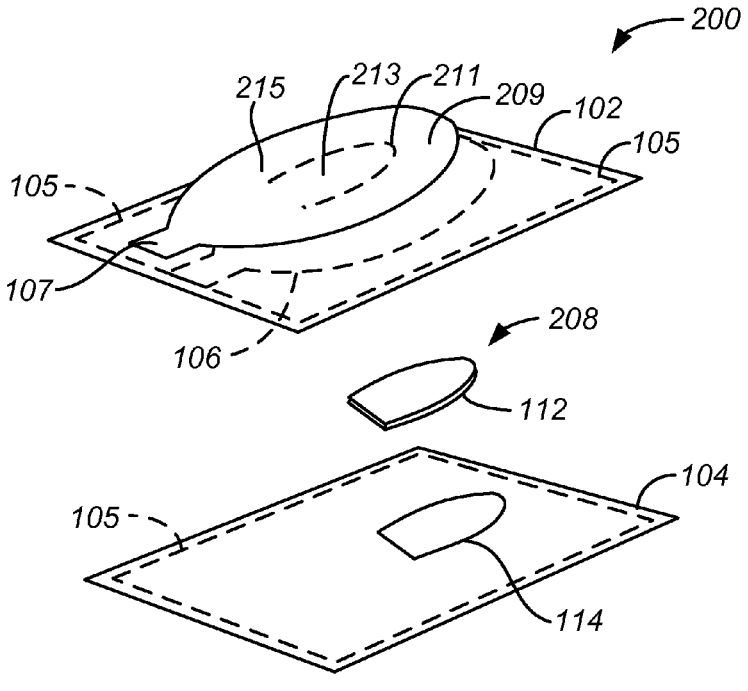
FIG. 2 illustrates a cosmetic system according to an exemplary embodiment of the present invention.

FIG. 2 shows cosmetic system 200 according to an alternate embodiment of the present invention.

Figure 3:
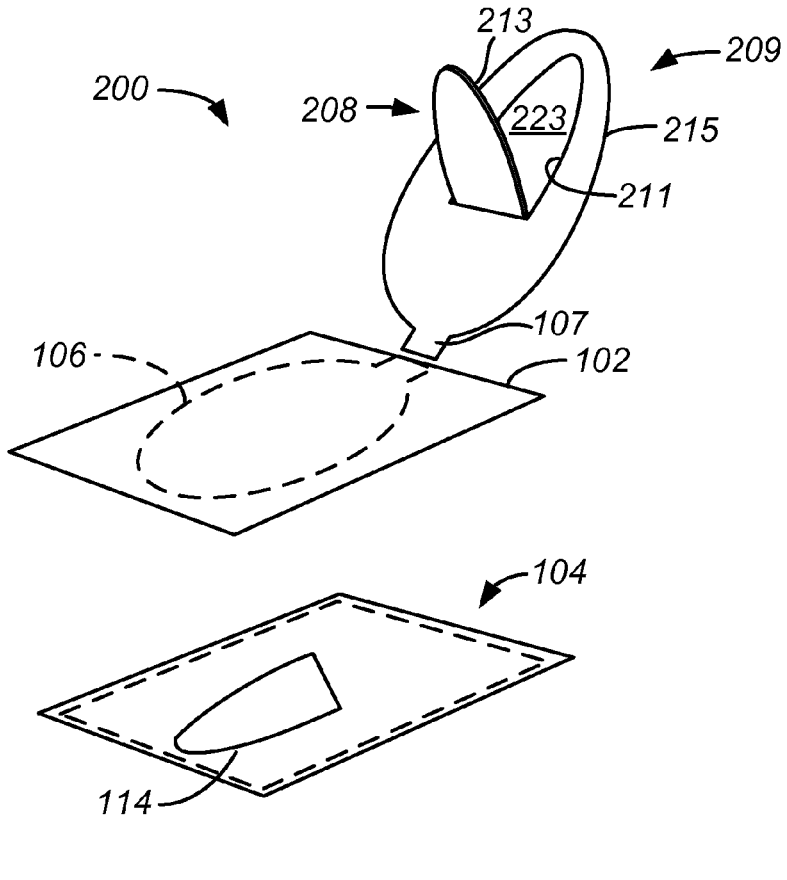
FIG. 3 illustrates the cosmetic system of FIG. 2 with its applicator top layer detached the top layer according to an exemplary embodiment of the present invention.

In FIG. 2, cosmetic system 200 comprises similar type components described with reference to FIG. 1. As in FIG. 1, cosmetic system 200 includes top layer 102 having applicator top layer 209. Applicator 208 is also shown. However, in FIG. 2, the areas (sizes) of top layer 209 and applicator 208 do not correspond. Rather, the area of applicator 208 is smaller and corresponds to area 213 defined by perforations 211. When perforations 211 are torn, applicator 208 attached to the underside of area 213 can be raised for use while sleeve area 215 remains away from applicator 208 so as not to interfere with the user applying makeup as shown in FIGS. 2, 3 and 4. Use of the embodiment of FIG. 2 will now be described with reference to FIGS. 3 and 4.

FIG. 3 illustrates cosmetic system 200 with applicator top layer 209 detached from top layer 102 according to an exemplary embodiment of the present invention.

In operation, and with reference to FIGS. 2, 3, and 4, user 101 wishing to utilize cosmetic system 200 for applying makeup such as lipstick to the lip area begins by grasping tab 107 and exerting a pulling force away from top layer 102. By so doing, user 101 begins to tear around perforations 106. Once tearing is completed, applicator top layer 209 with applicator 208 is completely detached from top layer 102.

Thereafter, user 101 begins to tear perforations 211 which define area 213 to which applicator 208 is attached. Once perforations 211 are completely torn, user 101 can raise applicator 208, leaving behind sleeve area 215 of applicator top layer 209. Sleeve area 215 behind user 101's finger is shown in FIG. 4. An advantage of the present embodiment is that the user's finger can be inserted in aperture 223 while sleeve area 215 engages around the user's finger. Moreover, only applicator 208 is in contact with the lip area while sleeve area 215 is tucked away behind user 101's finger. Sleeve area 215 does not interfere with application of lipstick to the lip area.

In this manner, users need not utilize their fingers for scooping the product and for applying the product onto the lip area. Furthermore, cosmetic system 100 is two-dimensional and flat and can fit within a mobile phone pouch along with the mobile phone itself. The user need not carry a pocketbook, a handbag or the like in unlike conventional cosmetic systems and methods.

While the above is a complete description of exemplary specific embodiments of the invention, additional embodiments are also possible. As an example, an additional embodiment is shown in FIG. 5.

Figure 5:
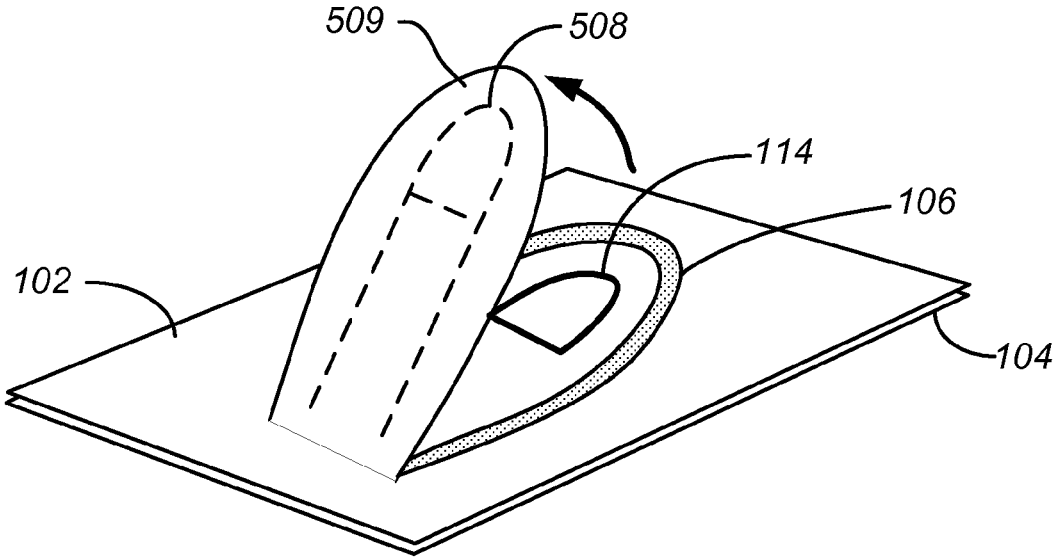
FIG. 5 illustrates a cosmetic system according to an exemplary embodiment of the present invention.

FIG. 5 shows cosmetic system 500 according to an alternate embodiment of the present invention.

In FIG. 5, cosmetic system 500 comprises similar type components described with reference to FIG. 1 except that applicator top area 509 and applicator 508 are not detachable from top layer 102. The above description as provided in this entire specification should not be taken as limiting the scope of the invention, which is defined by the appended claims along with their full scope of equivalents.

I claim:

1. A cosmetic device for applying makeup onto the lip area, said cosmetic device comprising:

a top planar cover that includes an applicator attached to on an interior surface of said top planar cover so that raising or partially detaching at least a portion of said top planar cover to which the applicator is attached also raises or detaches the applicator; and a bottom planar cover substantially congruent with said top planar cover, wherein edges of said bottom planar cover and edges of said top planar cover are bonded so that said applicator attached to said interior surface of said top planar cover is sealed between the interior surface of said top planar cover and an interior surface of said bottom planar cover, said top planar cover being configured such that said at least a portion of said top planar cover to which the applicator is attached is at least raiseable or partially detachable from said bottom cover to raise said applicator to facilitate application of makeup to the lip area.

2. The cosmetic device of claim 1 wherein said top planar cover includes perforations that define a periphery of said applicator.

3. The cosmetic device of claim 2 wherein said applicator is accessible for use by cutting along said perforations.

4. A cosmetic device comprising:

a top sheet that includes an applicator attached to an interior side of said top sheet so that raising or detaching at least a portion of said top sheet to which the applicator is attached also raises or detaches the applicator; and a bottom sheet substantially aligned with said top sheet, said bottom sheet having a product area substantially aligned with said applicator attached to said interior side of said top sheet, wherein said bottom sheet is attached to said top sheet along edges of the top and bottom sheets such that the applicator is between the interior side of said top sheet and an interior side of said bottom sheet, said top sheet being configured such that at least a portion of said top sheet having the applicator attached is at least partially detachable from said bottom sheet so as to lift the applicator and permit a user to employ said applicator to apply makeup.

5. The cosmetic device of claim 4 wherein said top sheet comprises perforations that define a periphery of said applicator.

6. A cosmetic device comprising:

a top cover that includes applicator perforations defining a periphery of an applicator attached to an inside surface of said top cover so that raising or detaching at least a portion of said top cover to which the applicator is attached also raises or detaches the applicator; and a bottom cover substantially aligned with said top cover, wherein said bottom cover is attached to said top cover along edges of the top and bottom covers such that the applicator is between the top cover and the bottom cover, wherein when said at least said portion of said top cover is raised by a user, said applicator attached to the inside surface of said top cover is raised along with said portion of said top cover to which said applicator is attached to the inside surface of said top cover.

7. The cosmetic device of claim 6 wherein said top cover further comprises detach perforations wherein upon tearing around said detach perforations, said top cover is detached from said cosmetic device, and wherein upon tearing around said applicator perforations, said applicator is raised from said top cover.

8. The cosmetic device of claim 7 wherein said top cover is detachable from said cosmetic device.

9. The cosmetic device of claim 8 wherein said applicator can be raised with said top cover when said top cover is detached from said cosmetic device.

10. The cosmetic device of claim 9 wherein upon raising said applicator, an aperture is created for insertion of a user's finger behind said applicator to allow application of makeup product to a lip area.

11. A cosmetic device comprising:

a top cover that includes an applicator on an interior cover of said top cover, the top cover also including perforations defining a periphery of said applicator; and a bottom cover substantially aligned with said top cover, wherein said bottom cover is attached to said top cover along edges of the top and bottom covers such that the applicator is between the interior side of said top cover and an interior side of said bottom cover, and wherein said applicator is accessible for use by tearing along said perforations wherein said applicator on said interior side of said to cover is lifted along with said top cover when said top cover is lifted to permit a user to use the applicator to apply makeup.

12. The cosmetic device of claim 11 wherein said bottom cover has a product area on the interior side of said bottom cover.

13. The cosmetic device of claim 12 wherein said applicator is aligned to remain on said product area when the cosmetic device is sealed.

14. The cosmetic device of claim 1 wherein said applicator is completely detachable form said top cover.

15. The cosmetic device of claim 11 wherein said top cover and said bottom cover as attached is two-dimensional.

16. The cosmetic device of claim 11 wherein said applicator is substantially for single-use.

17. A method comprising:

providing a top planar layer that includes an applicator on an interior side of said top planar layer; and attaching to said top planar layer, a bottom planar layer substantially congruent with said top planar layer, wherein said bottom planar layer is attached to said top planar layer along edges of the bottom and top planar layer so that said applicator on interior side of said top planar layer is sealed between the interior side of said top planar layer and an interior side of said bottom planar layer, and said top planar layer being configured such that at least a portion of said top planar layer to which the applicator is attached to the interior side is at least partially detachable from said bottom planar layer along with said at least a portion of said top planar layer to raise said applicator to facilitate application of makeup to the lip area.

18. The method of claim 17 further comprising providing a product area on an interior side of said bottom planar layer.

19. The method of claim 18 wherein the product area includes sufficient cosmetic product for substantial single use.

* * * * *